US005876863A

United States Patent [19]

Feldman et al.

[11] Patent Number: 5,876,863

[45] Date of Patent: Mar. 2, 1999

[54] ELECTROLUMINESCENT FILAMENT

[75] Inventors: Michael C. Feldman, San Carlos; Bryan D. Haynes, Pacifica, both of Calif.

[73] Assignee: Add-Vision, Inc., Pacifica, Calif.

[21] Appl. No.: 770,588

[22] Filed: Dec. 19, 1996

Related U.S. Application Data

[63] Continuation-in-part of Ser. No. 578,887, Dec. 22, 1995, Pat. No. 5,753,381.

[51] Int. Cl.[6] ..... H05B 33/00

[52] U.S. Cl. ..... 428/690; 428/917; 313/505; 313/506; 313/511; 313/512

[58] Field of Search ..... 428/690, 691, 428/917; 313/504–509, 511, 512

[56] References Cited

U.S. PATENT DOCUMENTS

| | | | |
|---|---|---|---|
| 3,052,812 | 9/1962 | Dow | 313/108 |
| 3,069,579 | 12/1962 | Berg et al. | 313/108 |
| 3,278,784 | 10/1966 | Masaharu | 313/108 |
| 3,571,647 | 3/1971 | Robinson | 313/108 |
| 3,803,437 | 4/1974 | Robinson | 313/108 |
| 3,819,973 | 6/1974 | Horsford | 313/108 |

OTHER PUBLICATIONS

Brochure of Electroluminescent Industries Ltd. (Rev. 4 16–Apr. –1996).

*Primary Examiner*—Charles Nold
*Attorney, Agent, or Firm*—Pillsbury Madison & Sutro LLP

[57] ABSTRACT

An electrically activated light emitting cylindrical or other shaped composite filament. A core conductor is optionally surrounded by a first optional insulation layer, surrounded by an outer electrode and an electroluminescent phosphor. The entire assembly may be coated with a second insulation layer. Light is produced by the phosphor when the core conductor and the outer electrode are connected to and energized by an appropriate electrical power supply. The filament may be used to form various one-, two- and three-dimensional light emitting objects.

25 Claims, 11 Drawing Sheets

ELECTROLUMINESCENT FILAMENT

This application is a continuation-in-part of U.S. application ser. No. 08/578,887, filed Dec. 22, 1995, U.S. Pat. No. 5,753,381 which is incorporated herein by reference.

BACKGROUND

The present invention relates to electroluminescent filaments ("EL filaments"). More specifically, the present invention relates to EL filaments, portions of which may be individually illuminated.

EL filaments have been known generally in the art; however, few have been produced beyond a test scale and the conventional filaments have had a series of problems, including low reliability and low light intensity. In addition, the conventional EL filaments lack sufficient flexibility to be made into one-, two-, and three-dimensional light emitting objects using textile fabrication technologies such as knitting, weaving, braiding, etc., that use raw materials in filamentary form.

Conventionally, EL filaments include a central solid core conductor coated with a luminescent material and an outer electrode that is made of either a single conductor wound around the core or a transparent conducting film coated onto the luminescing layer. Since the conventional filaments include only a single outer electrode or transparent coated electrode, it is not possible to energize individual portions of the conventional filaments. This is a drawback in applications which require different portions of the filament to be energized at different times; for example, applications that require animated visual effects. The conventional filaments that contain only one outer electrode have the additional drawback that if the outer electrode is broken anywhere along the filament, the whole filament ceases luminescing. This makes the conventional filaments easily susceptible to damage.

There therefore exists a need for a reliable, flexible EL filament that is capable of emitting high light intensity when energized and which may be made into articles or incorporated into articles using textile fabrication techniques. There is also a need for an EL filament, only portions of which may be energized at any one time. Moreover, there is a need for an EL filament which does not fail completely when only a part of the filament is damaged.

SUMMARY

The present invention addresses the above needs by providing an EL filament that includes a core conductor, a luminescing layer surrounding the core conductor, and a braided outer electrode either embedded in the luminescing layer or surrounding the luminescing layer. In one embodiment, the core conductor is a multi-strand conductor. In a preferred embodiment, the core conductor is a multi-stranded conductor, the braided outer electrode covers about 50% of the surface of the luminescing layer, and the luminescing layer includes an activated zinc sulfide encapsulated phosphor.

In another embodiment of the invention, the braided outer electrode includes a plurality of individually addressable electrodes. If the individual electrodes are insulated from one another, they may be individually energized thereby illuminating only a portion of the EL filament. One embodiment of the present invention that achieves the above includes a core conductor, a luminescing layer at least partially surrounding the core conductor, and two or more individually addressable electrodes disposed around the core conductor. In this embodiment of the invention, the individually addressable electrodes are insulated from one another; additionally, the individually addressable electrodes may be braided together to form an outer electrode, and may be embedded in the luminescing layer or disposed surrounding the luminescing layer.

To facilitate addressing the individual electrodes in the previous embodiment, the EL filament may also include a coupler for connecting the individual electrodes to the external power source. The coupler connects the closely spaced, fragile individual electrodes to more easily accessible, thicker more robust wires that may then be attached to the power circuit. The coupler may connect the individually addressable electrodes to two or more power inputs. Generally, a coupler includes robust, durable contacts connected to the more fragile individually addressable electrodes. These contacts are for connecting to the external power source and for supplying power to the individually addressable electrodes.

BRIEF DESCRIPTION OF THE DRAWINGS

The invention will be better understood with reference to the attached figures in which.

DETAILED DESCRIPTION

Figure 1:
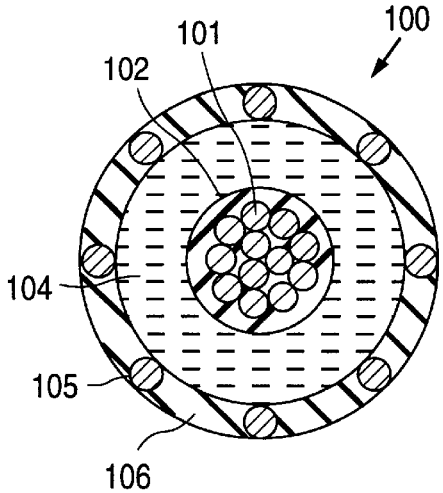
FIG. 1 shows a cross-sectional view of one embodiment of an electroluminescent filament according to the present invention.

We have found that when an EL filament is fabricated using a multi-strand core conductor and a braided outer electrode the resulting filament is flexible enough to be used in textile fabrication technologies, and also has a light emission intensity and reliability that will allow it to be used commercially. This combination of flexibility, reliability, and brightness enables the EL filaments of the present invention to be used in a variety of applications including illuminated logos, illuminated materials for use in night clothing, safety clothing, color change cloth, outlining objects for safety, illuminated embroidery, and illuminated needlepoint. In addition, the EL filaments of the present invention may be braided over a non-conducting core such as a cotton fiber. This will produce a thicker more robust light emitting fiber which can be woven into belts etc, or which may be used to make illuminated nets which may be used, for example, in basketball, tennis, etc.

Generally, an electroluminescent filament according to the present invention includes a core conductor, a luminescing layer surrounding the core conductor, and an outer electrode surrounding the core conductor and insulated from the core conductor. By "surrounding" we mean that element A surrounds element B if element A at least partially covers the surface of element B. As used here, element A does not have to be in contact with element B to surround it; moreover, element A does not have to cover the entire surface of element B to surround it. For example, as used here, a helical shaped wire wound around but not touching a core, "surrounds" the core.

The electroluminescent filament may optionally include a first insulation layer surrounding the core conductor and a second insulation layer surrounding the luminescing layer. In one embodiment of the invention, the outer electrode may surround the luminescing layer. In an alternative embodiment, the outer electrode may be embedded in the luminescing layer. If the filament includes a second insulation layer the outer electrode may be embedded in this insulation layer. To provide strength while maintaining flexibility, the core may be multi-stranded and the outer electrode braided. As described in detail below, additional braided layers may be added to improve strength, cut-through resistance, etc.

Generally, an electroluminescent filament produces light in response to an alternating or pulsed DC current source connected across the core conductor and outer electrode. The core conductor and the outer electrode can be connected across a voltage source in order to produce light as desired. It is possible to use more than one voltage source with a single filament. This may be the case if more than one outer electrode is present in the filament (see below) or if a multi-stranded core conductor is used.

The electroluminescent filaments of the present invention may be used to fabricate shapes that emit light when they are connected to and energized by the appropriate electrical power supply. The filaments of the present invention are flexible enough to be knitted, woven, braided, etc. using textile fabrication technologies that use raw materials in filamentary form. Using these technologies, the filaments of the present invention may be used to make all sorts of one, two, and three dimensional light emitting objects. Examples of such objects include clothing, works of art, molded parts, and informational displays. In clothing, for example, electroluminescent threads can be used to embroider logos, designs, or other accents.

FIG. 1 shows one embodiment of an electroluminescent filament according to the present invention. The filament 100 includes a core conductor 101, a first insulating layer 102, a luminescing layer 104, an outer electrode 105, and a second insulating layer 106.

Core conductor

The core conductor 101 is a conductor or semi-conductor, and may be of a single or multiple filamentary metallic or carbonaceous material, other electrically conducting or semi-conducting materials or combinations thereof. The core conductor 101 may be solid or porous. The cross-sectional shape of the core conductor 101 may be circular, flat, or any other acceptable geometry. Preferably, the core conductor 101 is a multiple-strand configuration of conducting filaments because bundles of fine filaments are more flexible than a solid individual filament. The multiple-strand configuration adds strength and flexibility to the filament.

Accordingly, in a preferred embodiment of the filament, the core conductor is a multi-strand core conductor. These multi-strand core conductors may be in a parallel, coiled, twisted, braided, or another acceptable configuration or arrangement. The number of strands, their individual diameters, composition, the method of packing and/or number of twists may be of any combination.

A particularly preferred core conductor material is a 19-strand bundle of stainless steel conductor filaments. Each strand (filament) is about 50 gauge (roughly equivalent to about 0.001 inch dia.). Each strand bundle has a fluorinated ethylene propylene (FEP) insulation layer about 0.002 inch thick, with an overall wire conductor outside diameter of about 0.012 inch (insulation inclusive). Such a core conductor is available from Baird Industries (Hohokus, N.J.).

First Insulation Layer

FIG. 1 shows an embodiment of the invention in which the filament or filaments of the core conductor are surrounded by a first insulation layer 102 of insulating material. While the first insulating layer 102 is not required to practice the invention, its presence is preferred. The first insulating layer 102 serves to reduce the probability of shorts between the core conductor and an outer electrode, thus increasing reliability.

In the embodiment shown in FIG. 1, the first insulation layer 102 surrounds the core conductor In the case of a multi-strand core conductor, each strand may be individually surrounded by an optional first insulation layer. An additional insulation layer may also surround the entire bundle of individually surrounded strands.

Luminescing Layer

FIG. 1 shows an embodiment of the invention which includes a luminescing layer 104 surrounding the insulation layer or layers. The luminescing layer 104 preferably comprises "phosphor." Phosphor is a term that has evolved to mean any material that will give off light when placed in an electric field. The light may be of a variety of wavelengths. The luminescing layer 104 may be deposited as a continuous or interrupted coating on the outer surface of the core conductor's insulation layer. When the luminescing layer 104 is deposited as an interrupted coating, the result may a striped or banded, light producing product. If there is a plurality of individually insulated strands, the luminescing layer may be coated on each strand or disposed between the insulated strands.

Alternatively, the phosphor may be compounded directly into the first insulation layer and applied by extrusion or another process. In this embodiment, the first insulation layer and the luminescing layer are the same layer.

Typically, phosphor is comprised of copper and/or manganese activated zinc-sulfide particles. In a preferred embodiment, each phosphor particle is encapsulated to improve service life. The phosphor may be either neat or in the form of a phosphor powder/resin composite. Suitable resins include cyanoethyl starch or cyanoethyl cellulose, supplied as Acrylosan® or Acrylocel®by TEL Systems of Troy, Mich. Other resins, possessing a high dielectric strength, may be used in the composite matrix material.

A particularly preferred material for use in the luminescing layer 104 is the phosphor-based powder known as EL phosphor, available as EL-70 from Osram Sylvania Inc. (Towanda, Pa.). A preferred formulation for the composite is 20% resin/80% phosphor by total weight of the composition. However, other weight ratios may be used.

Other phosphors are available which emit different wavelengths of radiation, and combinations of phosphors may be used.

The luminescing layer 104 may be deposited in any number of ways, such as: thermoplastic or thermoset processing, electrostatic deposition, fluidized powder bed, solvent casting, printing, spray-on application or other acceptable methods.

Another method for attaching the luminescing layer 104 to the first insulation layer, or to other suitable layers, if suitable for use with the materials in question, is to soften the first insulation layer 102, or other suitable layers with heat, or a solvent or other method and then to imbed the phosphor material into the first insulation layer 102, or other suitable layers.

Outer electrode

FIG. 1 shows an embodiment of the invention in which an outer electrode 105 surrounds the luminescing layer 104. In another embodiment of the invention, the outer electrode 105 may be applied before or simultaneously with the luminescing layer 104. The outer electrode 105 comprises an electrically conductive or semi-conductive material, and preferably, the outer electrode has a braided filamentary structure. By "braided filamentary structure" we mean a plurality of individual electrodes that are braided together. The individual electrodes that make up the braided outer electrode may be coated or uncoated. One advantage of an EL filament that includes a braided outer electrode is that if any of the individual electrodes that make up the braided structure are damaged the filament will continue to luminesce; only if all of the electrodes in the braided electrode are damaged will the filament cease luminescing. The filaments of the present invention therefore have a built in redundancy in the outer electrode; a feature which makes the filaments of the present invention more durable than conventional filaments that contain only one individual outer electrode. Examples of suitable outer electrode materials include metal, carbon, metal coated fibers, inherently conducting polymers, intrinsically conducting polymers, compounds containing indium tin oxide, and semiconductors. Other outer electrode configurations include: perforated wrap-around metallic foils (wherein the perforations may be of any shape, i.e., circular, slot or other); electrically conducting knitted, woven or non-woven cloth or fabric; non-woven mat material such as overlapping electrically conducting whiskers or tinsel; any other electrical conductor; or any combination of these materials. The outer electrode is preferably made of a non-transparent material. In this case, it is also preferred that the outer electrode is non-continuous (e.g., braided structure, foraminous, etc.) to allow the electro-luminescence generated in the luminescent layer to be emitted through the outer electrode.

Second Insulation Layer

FIG. 1 shows an embodiment of the invention which includes a second insulation layer 106 within which the outer electrode 105 is embedded. In an alternative embodiment the insulation layer 106 may surround the outer electrode 105. The second insulation layer 106 is preferably comprised of an optically transparent, electrically insulating material, such as an amorphous or crystalline organic or inorganic material. The second insulation layer 106 may be applied in liquid or other form with a subsequent cure or other process that may result in a permanent, semi-permanent, or temporary protective layer. Particularly preferred materials include epoxies, silicones, urethanes, polyamides, and mixtures thereof. Other materials may be used to achieve desired effects. The transparent, electrically insulating, materials may also be used in other layers.

The second insulation layer 106 is not required, but is desirable to improve reliability. The second insulation layer 106 also improves the "feel" (i.e., surface texture) of the filament and resulting goods made from the filament.

A silicone coating resin, such as Part No. OF113-A & -B, available from Shin-Etsu Silicones of America (Torrance, Calif.), may be used for the second insulation layer 106. The silicone resin KE1871, available from Shin-Etsu Silicones of America, may also be used for the second insulation layer 106.

Figure 2:
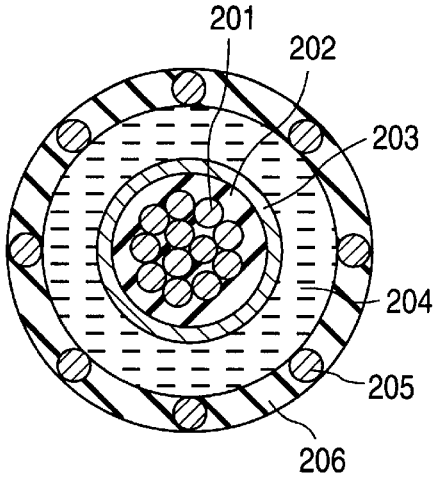
FIG. 2 shows a cross-sectional view of one embodiment of an electroluminescent filament according to the present invention.

FIG. 2 shows an embodiment of the present invention that includes a core conductor 201, surrounded by a first insulation layer 202, which is surrounded by an interlayer 203. The interlayer 203, is surrounded by the luminescing layer 204, which is surrounded by a second insulation layer 206, having embedded within it an outer electrode 205.

In this embodiment, the luminescing layer 204 is attached to the outermost surface of the first insulation layer 202 using one or more adhesion promoting interlayers 203. Interlayers 203 may be used generally to promote interlayer adhesion, or for other desired effects, such as modification of dielectric field strength or improved longitudinal strain performance. To promote adhesion to the surface of the first insulation layer, any process to modify the surfaces properties may be used, such as: mechanical abrasion, chemical etching, physical embossing, laser or flame treatment, plasma or chemical treatment or other processes to improve the surface properties.

Figure 3:
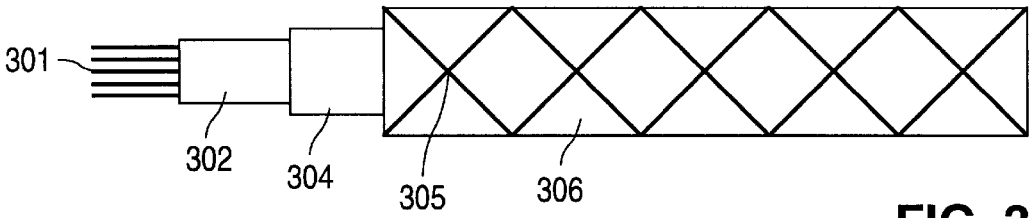
FIG. 3 shows a longitudinal elevation of one embodiment of an electroluminescent filament according to the present invention.
Figure 10:
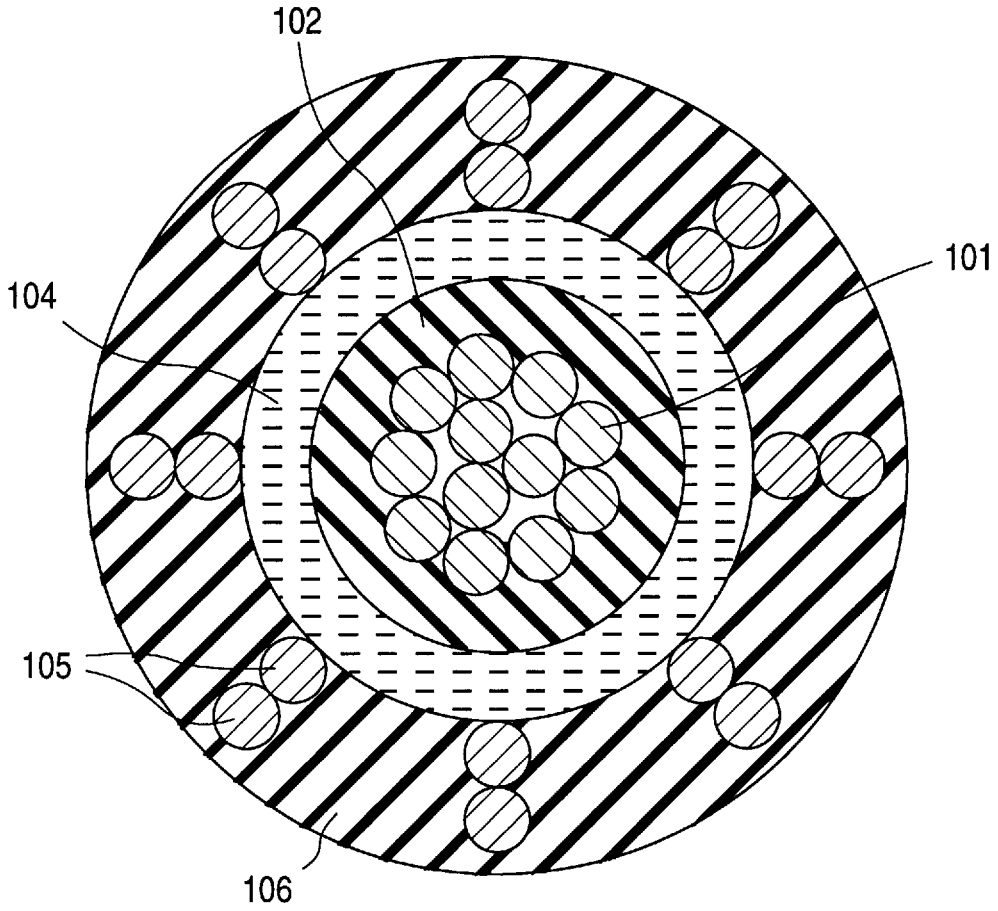
FIG. 10 shows a cross-sectional view of one embodiment of an electroluminescent filament according to the present invention.

FIG. 3 shows an embodiment of the invention that includes a core conductor 301 surrounded by a first insulation layer 302, which is surrounded by a luminescing layer 304. The luminescing layer 304 is surrounded by a second insulation layer 306, having embedded within it a braided outer electrode 305. The braided outer electrode may include three or more individual electrodes forming a diagonal pattern. The individual electrodes may be intertwined. The braided structure may form a wire grid. Braids may include counter-wound individual electrodes having an under and over geometry. FIG. 10 shows a more detailed depiction of the over and under geometry of a counter-wound braid 105. Braided structures add strength and flexibility to the filament.

The braided outer electrode may be formed from several different individual electrodes which can have the same or different gauges. The individual electrodes can have the same or different sizes, shapes, and compositions. In the embodiment shown, the individual electrodes are braided over the electroluminescent core. Preferably, the braid covers about 50% of the electroluminescent core although more or less coverage may be, used in specific applications.

Figure 4:
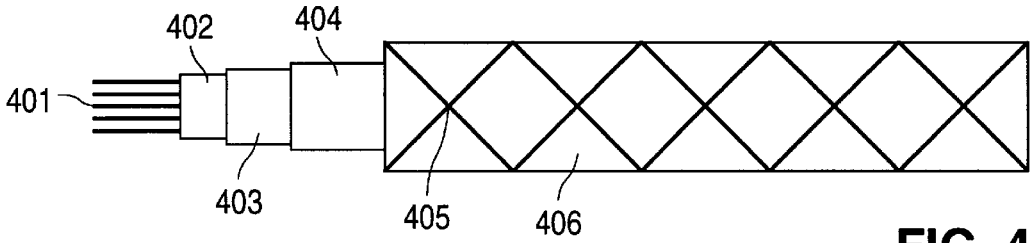
FIG. 4 shows a longitudinal elevation of one embodiment of an electroluminescent filament according to the present invention.

FIG. 4 shows an embodiment of the invention that includes a core conductor 401 surrounded by a first insulation layer 402, which is surrounded by an interlayer 403. The interlayer 403, is surrounded by the luminescing layer 404, which is surrounded by a second insulation layer 406, having embedded within it an electrode 405. The interlayer 403 is preferably an adhesion promoting interlayer, but may also serve some other purpose in improving the operation of the filament.

Figure 5:
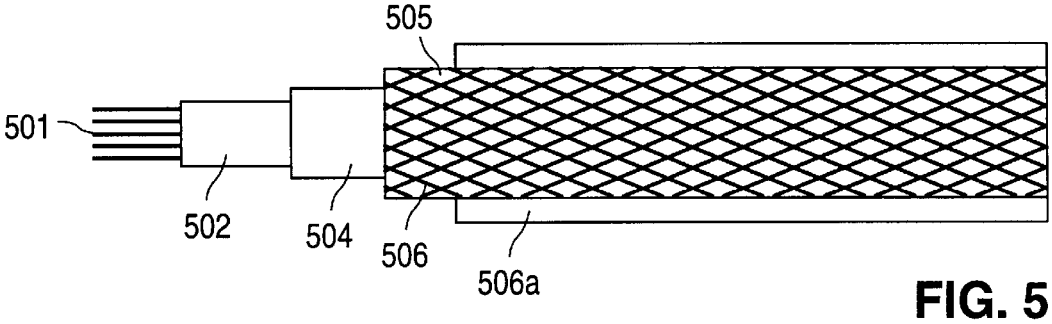
FIG. 5 shows a longitudinal elevation of one embodiment of an electroluminescent filament according to the present invention.

FIG. 5 shows an embodiment of the invention that includes a core conductor 501 surrounded by a first insulation layer 502, which is surrounded by an luminescing layer 504. The luminescing layer 504 is surrounded by a second insulation layer 506 which is surrounded by an electrode 505. The outer electrode 505 is surrounded by an additional protective layer 506*a*. The additional protective layer 506*a* may be of any of the materials generally disclosed herein.

Figure 6:
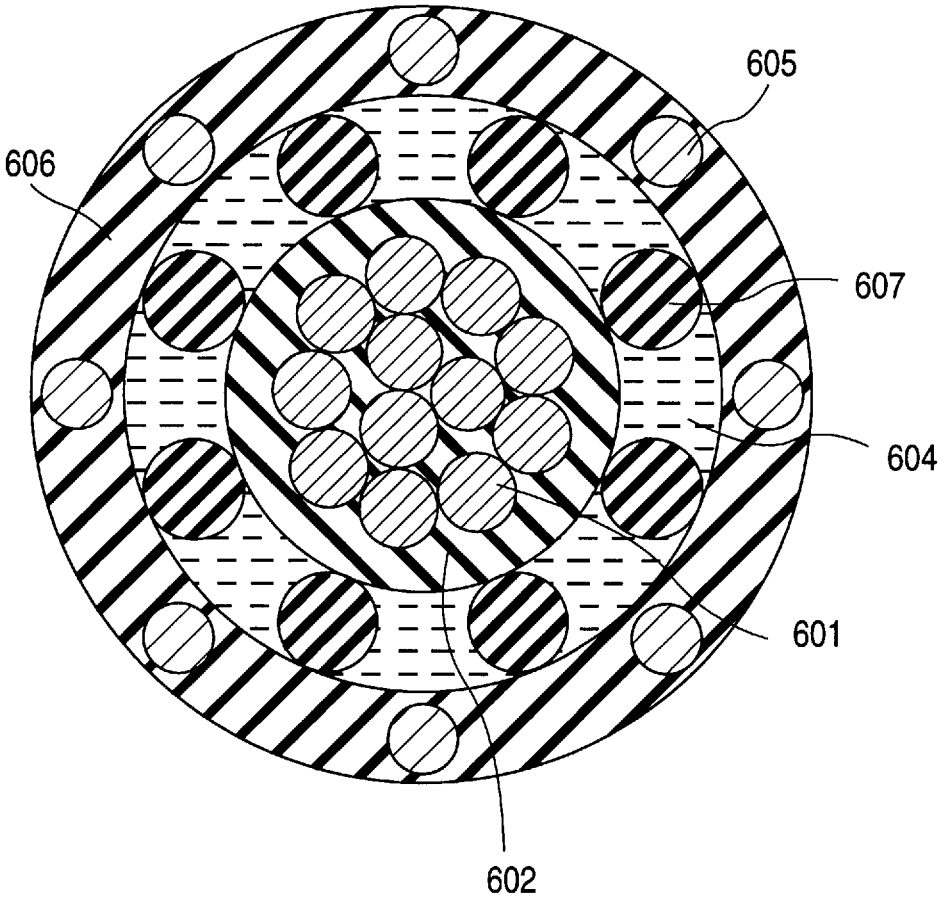
FIG. 6 shows a cross-sectional view of one embodiment of an electroluminescent filament according to the invention.

FIG. 6 shows an embodiment of the invention that includes a dielectric braid 607 surrounding the first insulation layer 602 and embedded in the luminescing layer 604. To form the dielectric braid 607, a dielectric fiber is braided, spiral wrapped, or applied using a combination of both geometries, onto the first insulation layer 602. The dielectric braid 607 may also be produced by braiding, spiral wrapping, or using a combination of both geometries, a dielectric fiber onto the core conductor 601, such that the dielectric braid 607 surrounds the core conductor 601. The dielectric braid 607 also surrounds the core conductor 601, or the first insulation layer 602 that surrounds the core conductor 601.

Generally, dielectric braiding may be used in any of the layers of the invention, using dielectric fibers as described below.

The dielectric fibers forming the dielectric braids described herein may be made of glass, Kevlar®, polyester, acrylate, or other organic or inorganic materials suitable for use as dielectric fibers. The luminescing layer(s) described herein is applied over this dielectric braid. The dielectric fiber layer then acts as a coating thickness controller and may aid in adhering the luminescent layer to the core conductor.

This adhesion improvement is particularly helpful when the first insulation layer is a low friction and/or low adhesion coating, such as a fluoropolymer coating. Additionally, the dielectric fiber layer provides improved resistance to "cut-through" and improved axial strength because the dielectric fiber layer will act as a strength member. The outer electrode described herein may be then directly applied to the phosphor containing dielectric fiber layer, and the second insulation layer described herein is applied to the outer electrode.

Figure 7:
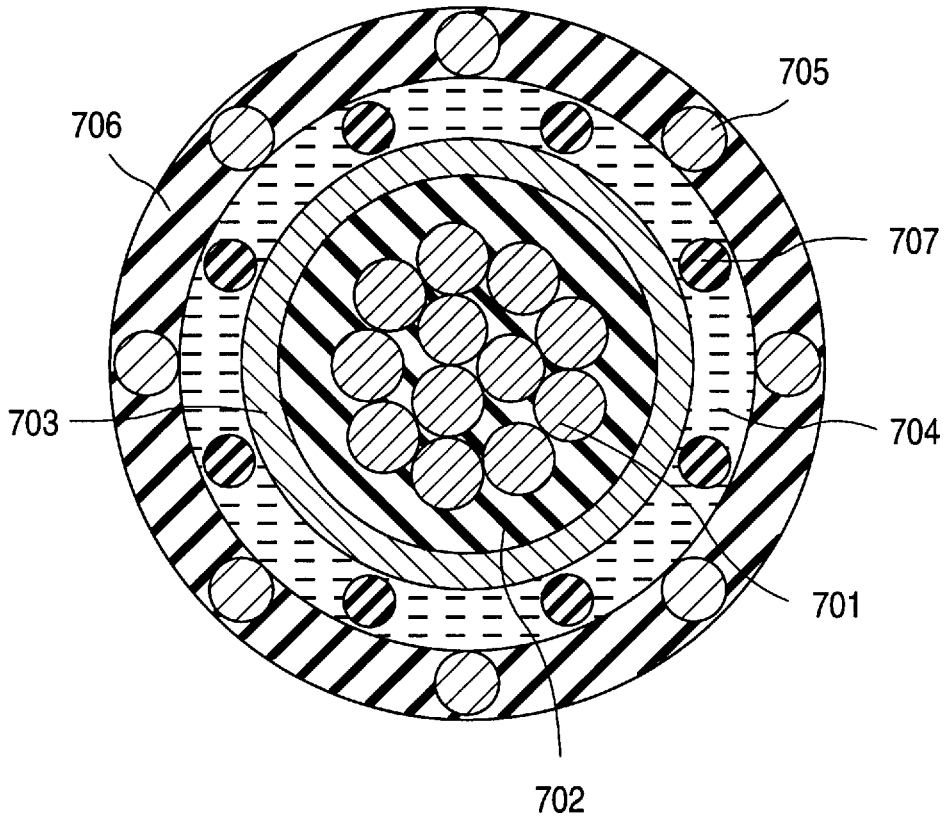
FIG. 7 shows a cross-sectional view of one embodiment of an electroluminescent filament according to the present invention.

FIG. 7 shows an embodiment of the invention that includes a core conductor 701 surrounded by a first insulation layer 702, which is surrounded by an interlayer 703. The interlayer 703 is surrounded by a dielectric braid 707, similar to the dielectric braid 607 of FIG. 6. The luminescing layer 704 is coated over the dielectric braid 707, similar to the relationship between the luminescing layer 604 and the dielectric braid 607 of FIG. 6. Surrounding the luminescing layer 704 is the second insulation layer 706, having embedded within it the outer electrode 705.

Figure 8:
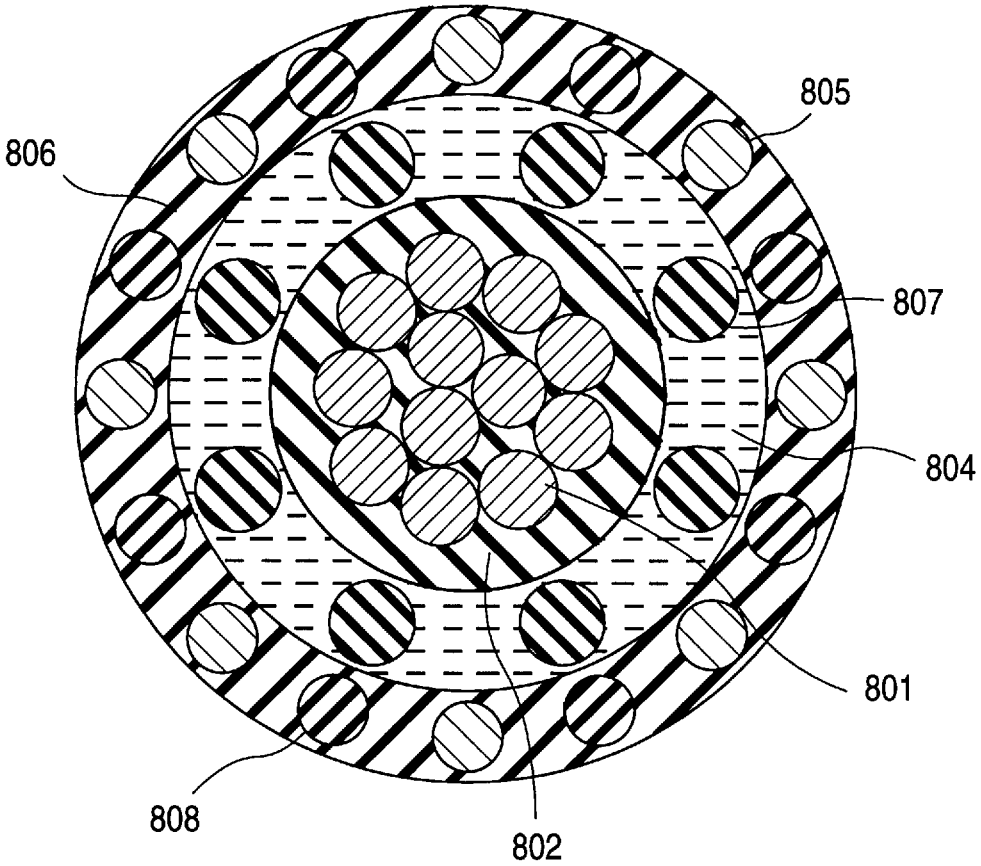
FIG. 8 shows a cross-sectional view of one embodiment of an electroluminescent filament according to the present invention.

FIG. 8 shows an embodiment of the invention that includes a core conductor 801 surrounded by a first insulation layer 802, which is surrounded by a dielectric braid 807, similar to the dielectric braid 607 of FIG. 6. The luminescing layer 804 is coated over the dielectric braid 807, similar to the relationship between the luminescing layer 604 and the dielectric braid 607 of FIG. 6. Surrounding the luminescing layer 804 is the second insulation layer 806, having embedded within it both the outer electrode 805 and a second dielectric braid 808. The second dielectric braid 808 may be of the same materials as the dielectric braid already described.

Figure 9:
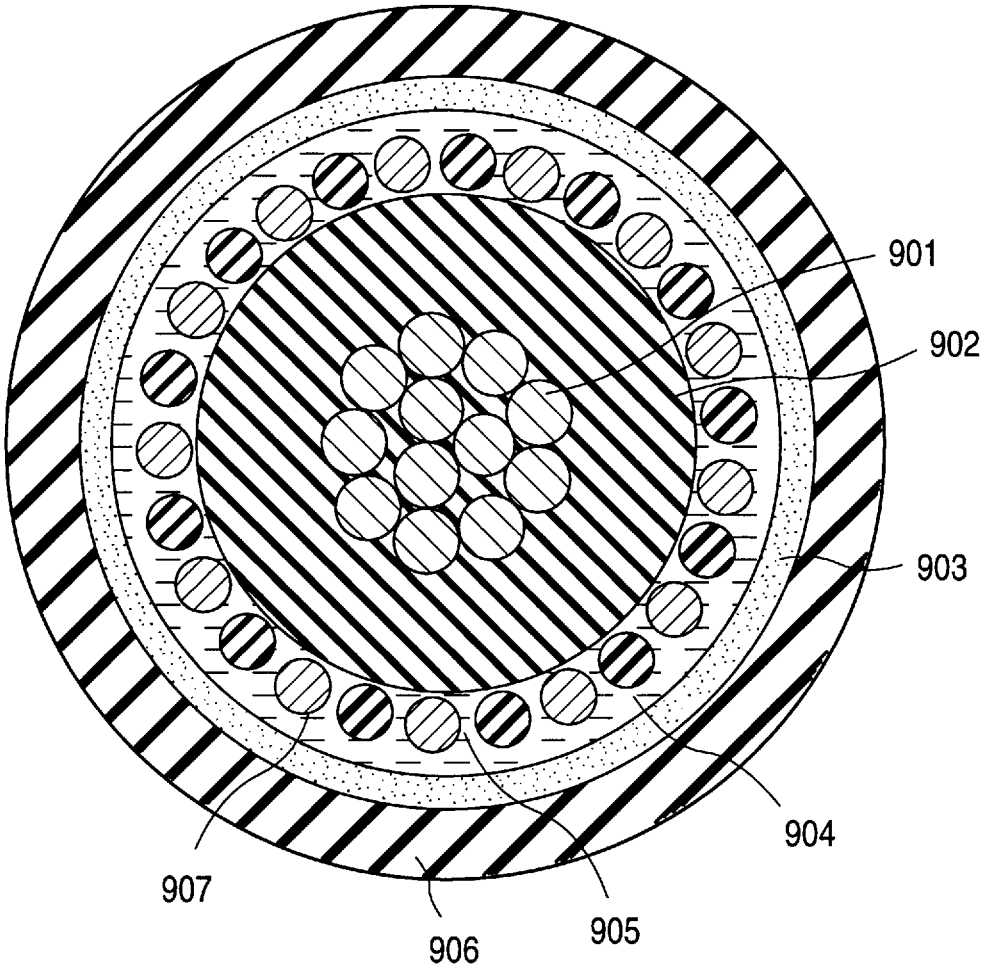
FIG. 9 shows a cross-sectional view of one embodiment of an electroluminescent filament according to the present invention.

FIG. 9 shows an embodiment of the invention that includes an outer electrode 905, for example a braided wire electrode, that is applied directly on the first insulation layer 902. In another embodiment, the outer electrode 905 may be applied directly on the core conductor 901, so long as they are insulated in some way. In the embodiment shown, the entire structure is then coated with the material of the luminescing layer 904. The outer electrode 905 is then embedded in the luminescing layer 904. The outer electrode 905 thus applied may be combined with dielectric materials. For example, if the outer electrode 905 is a braided wire electrode, it may be combined so as to be co-braided with a dielectric braid 907 directly onto either the optional first insulation layer 902, or the core conductor 901 directly. An interlayer 903, for example an adhesion promoting interlayer, may also be present if desired.

Additional layers or fillers may be added, or the above mentioned layers may be modified. For example, the use of transparent colored materials and/or translucent materials in the layers may alter the spectrum of emitted light, thereby producing different colors. Opaque materials may be used in the layers, producing, for example, a striped product. Phosphorescent (i.e., "glow-in-the-dark", and reflective materials may also be used. The reflective materials may be particulates, or they might be sheet material.

Other additives may be used to correct color output and filter the spectral emission. For example, a laser dye may be added to the phosphor composition or coated on top of the phosphor composition or coated on top of the phosphor coating. This material will alter the spectral emission.

Additional layers, not herein described, may be added, as long as they result in a usable electroluminescent filament, as would be recognized by one of ordinary skill.

Individually Addressable Electrodes

Figure 11:
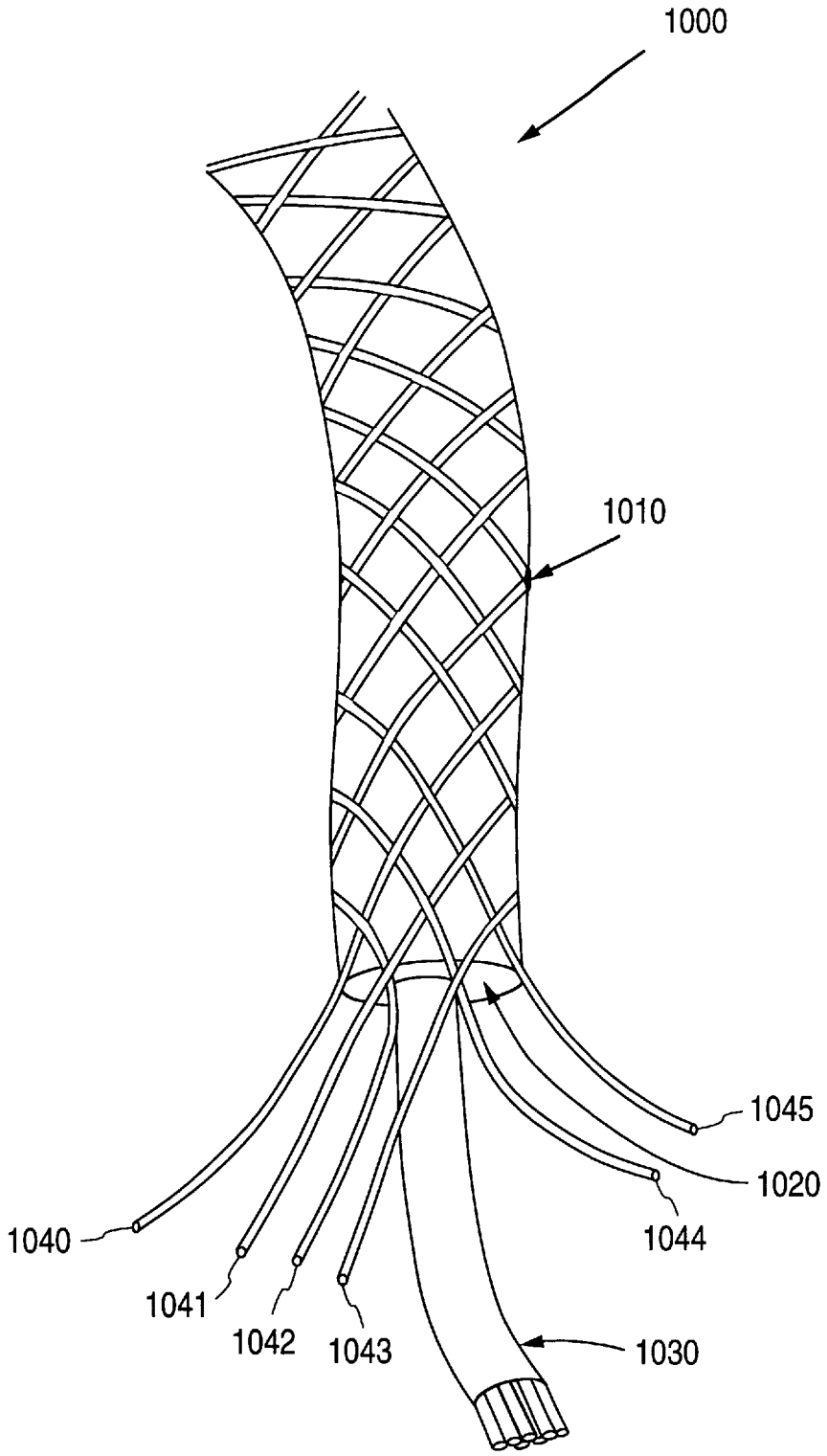
FIG. 11 shows a perspective side view of one embodiment of an electroluminescent filament according to the present invention.

FIG. 11 shows an electroluminescent filament 1000 according to the present invention that includes a braided outer electrode 1010, a luminescent layer 1020, and a core conductor 1130. The figure shows a braided outer electrode 1010 that includes a plurality (six in the embodiment in FIG. 11) of individually addressable electrodes 1040–1045. In this embodiment, the individually addressable electrodes are insulated from one another. This may be achieved, for example, by braiding the outer electrode 1010 using individually insulated electrodes 1040–1045. This embodiment may optionally include insulation layers, interlayers, dielectric braids, and other layers as described above.

In operation, the individually addressable electrodes of this embodiment may be "energized" individually. By "energized" we mean that an AC (or pulsed DC) voltage difference is applied between an individual electrode and the core conductor. If the individually addressable electrode that is energized is insulated from the other individual electrodes, an electric field will only be produced in the space between the energized electrode and the core conductor. Therefore, only the phosphor in the luminescent layer that is between the energized electrode and the core conductor will electroluminesce. In this way, it is possible to make only portions of the EL filament emit light.

Figure 12:
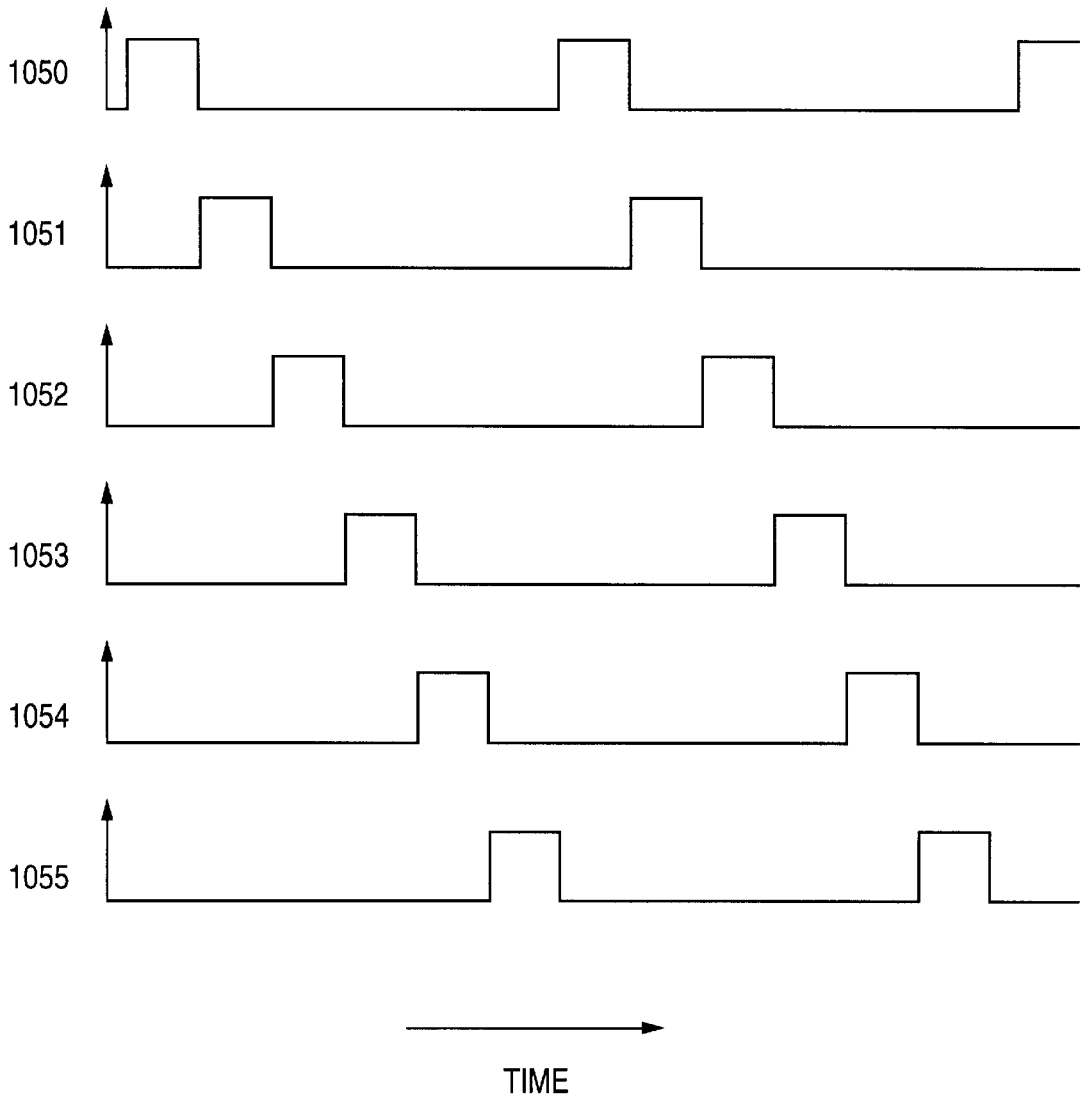
FIG. 12 shows a series of wave forms that may be used for driving the electroluminescent filament of FIG. 11.

FIG. 12 shows an example of a set of voltage waveforms that may be used to produce a chasing light pattern in the EL filament of FIG. 11. In FIG. 12, wave form 1050 corresponds to the voltage applied between the core conductor and electrode 1040, wave form 1051 corresponds to the voltage applied between the core conductor and electrode 1041, etc. By controlling the sequence of excitation of each electrode individually, any number of time dependent light patterns and effects can be produced. In one embodiment of the invention, the individual electrodes are energized in a sequence that is controlled using a microprocessor. The use of a microprocessor to control multiple electroluminescent lamps has been described previously in U.S. patent application Ser. No. 08/698,973, filed Aug. 16, 1996, which is incorporated herein by reference. By sequentially energizing the braided individually addressable electrodes using waveforms similar to those shown in FIG. 12, a spiral chasing light pattern was observed. By controlling the sequence of the individual electrodes, it will be possible to produce many different light patterns such as barber pole effects, and moving stripes. In addition, by selectively registering colored layers with the positions of the individual electrodes, it will be possible to make the EL filament emit different colors when different individual electrodes are energized.

Figure 13:
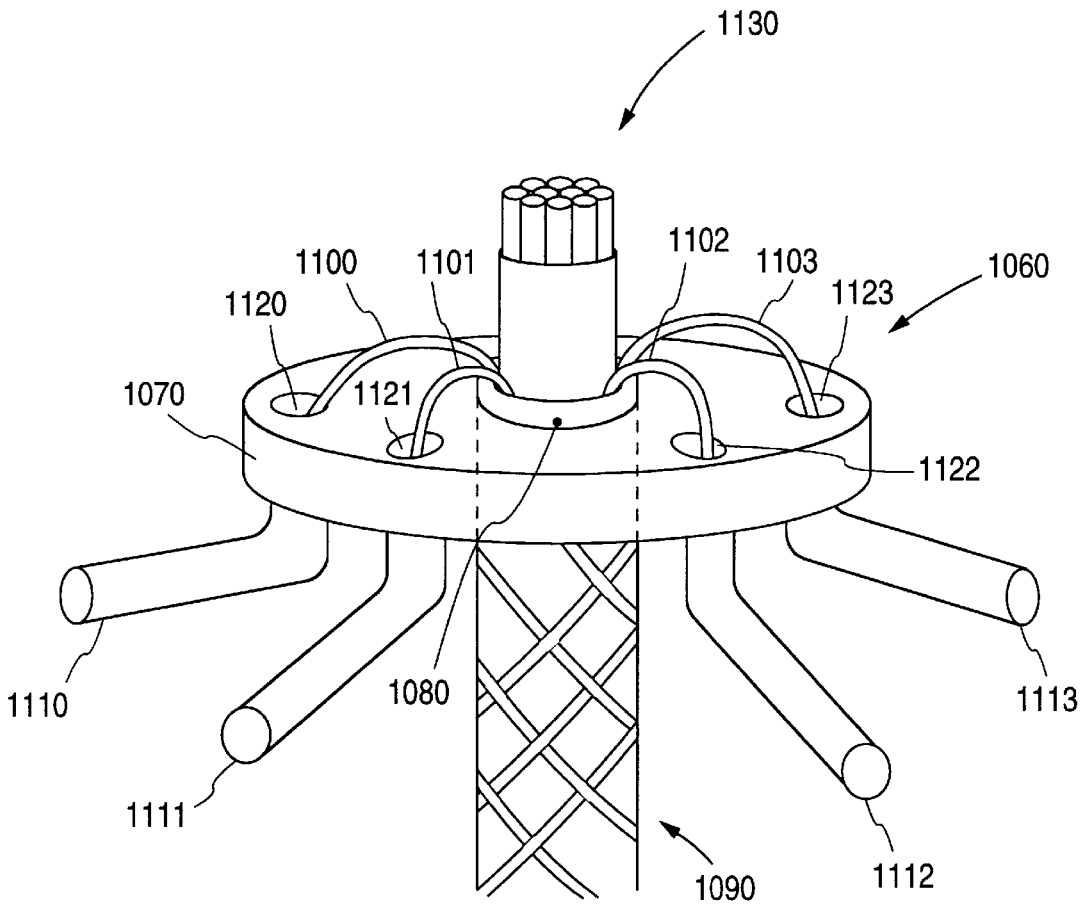
FIG. 13 shows a perspective top view of one embodiment of a coupler according to the present invention connected to an electroluminescent filament according to the present invention.

FIG. 13 shows one embodiment of a coupler 1060 for facilitating coupling the individually addressable electrodes to the power source. In this embodiment, the coupler 1060 includes a separator or manifold 1070 that has an opening 1080 to accommodate the EL filament 1090. The individually addressable electrodes 1100–1103 (4 electrodes in this example) are electrically connected to wires 1110–1113 via contact pads 1120–1123. The core conductor 1130 is also exposed to be connected to the power source. The wires 1110–1113 are more robust and durable than the individually addressable electrodes 1100–1103 and these wires are connected to the power supply circuits and microprocessor controller. The individually addressable electrodes may be connected to the contact pads via conventional methods; for example, soldering.

Figure 14A:
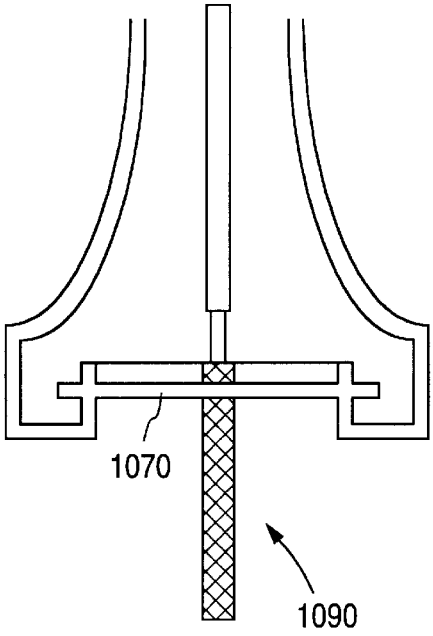
FIG. 14A shows a cross-sectional view of one embodiment of a coupler according to the present invention connected to an electroluminescent filament according to the present invention.
Figure 14B:
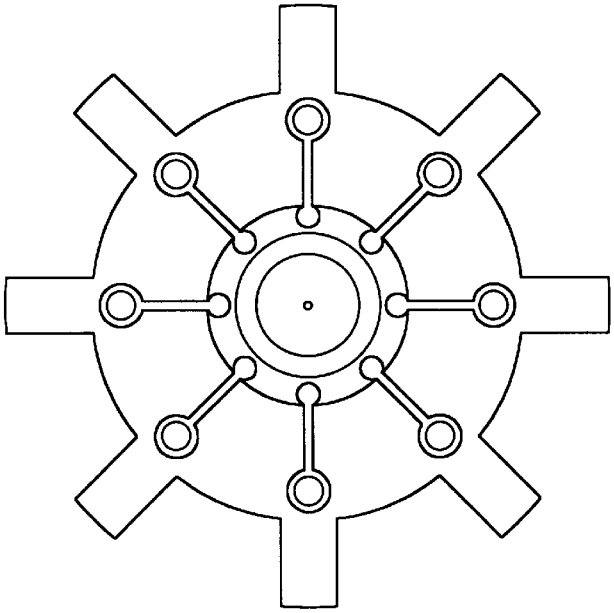
FIG. 14B shows a top plan view of the coupler of FIG. 14A.

FIGS. 14A and 14B shows cross-sectional and plan views of a connector similar to that shown in FIG. 13.

Figure 15:
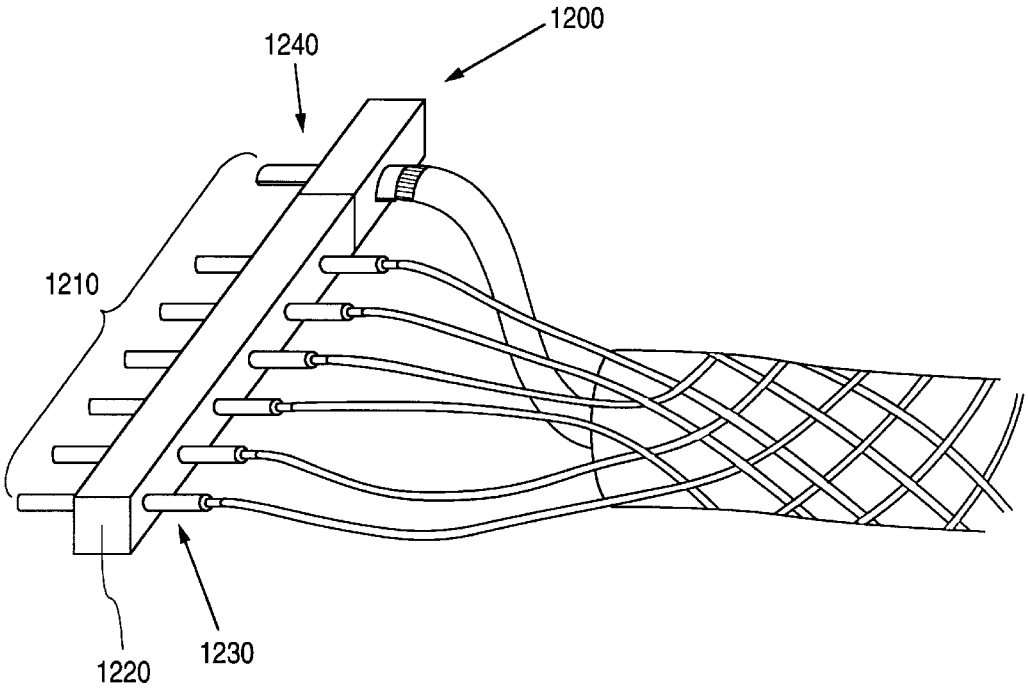
FIG. 15 shows a perspective top view of one embodiment of a coupler according to the present invention connected to an electroluminescent filament according to the present invention.

FIG. 15 shows another embodiment of a coupler according to the present invention. In this embodiment the coupler 1200 includes a set of conducting pins 1210 mounted in a separator 1220. One end 1220 of the pins 1210 is connected to the individually addressable electrodes and the core conductor. Again, the electrodes and the conductor may be attached to the pins using conventional methods such as soldering. In operation, the end 1230 of the pins not connected to the electrodes is connected to the power supply. Generally, a coupler includes a means for connecting the fragile individual electrodes to the external power supply. It is preferred that this means includes durable, robust contacts connected to the individual electrodes and for supplying power to the more fragile electrodes. In addition, the coupler may also serve to spatially separate the individually addressable electrodes for easy access and manipulation.

When an El filament includes individually addressable electrodes, it is possible to remove the core electrode completely. In this embodiment of the invention, a voltage difference is applied between different individually addressable electrodes in the outer electrode. This voltage difference produces an electric field which causes the luminescent layer to emit light. In this embodiment of the invention, the conducting core may be absent altogether or may be replaced by a non conducting core, which may be used to add strength to the filament. In this embodiment of the invention, it is preferred that the outer electrode is embedded in the luminescing layer.

Example of an EL Filament According to the Present Invention

A core conductor, comprised of a 19 strand bundle of 50 gauge wire, is selected. The entire bundle has a 2 mil thick fluoropolymer insulation coating that forms the first insulation layer. The first insulation layer is then coated with a particulate composite of an 80/20% by weight phosphor powder and resin mixture.

The particulate composite is prepared as a solution/suspension by mixing the appropriate ratio of phosphor powder and resin with a 50/50 mixture of acetone and dimethylacetamide. The viscosity of the solution/suspension may be adjusted by varying the solvent/solids ratio. To apply the coating, the core conductor is passed through a vertically oriented reservoir of phosphor composite, with a coating die at the bottom of the reservoir controlling the coating's thickness during the deposition process. The solvents are removed from the wet coating as the wire passes through a series of in-line, heated tube furnaces. The result is a solidified composite coating containing the phosphor. Using a binary blend of solvents assists the drying process, as the two solvents evaporate at different rates due to differences in boiling points. The finished product is a uniform, concentric and approximately 2 mil thick phosphor coating forming the luminescing layer on the first insulation layer.

Next, a 16-count (number of carriers) braider is used to produce a 50% coverage of 1 mil diameter wire over the luminescing layer. This braid forms the outer electrode.

Finally, a second coating reservoir with an appropriate diameter sizing die is used to apply the second insulation layer onto the wire. The coated filament is passed through in-line tube furnaces to convert the second insulation layer into its final form.

What is claimed is:

1. An electroluminescent filament, comprising:

(a) a core conductor;

(b) a luminescing layer at least partially surrounding the core conductor; and (c) two or more individually addressable electrodes disposed around the core conductor.

2. The electroluminescent filament according to claim 1, wherein the individually addressable electrodes are insulated from one another.

3. The electroluminescent filament according to claim 2, wherein the individually addressable electrodes are braided together to form an outer electrode.

4. The electroluminescent filament according to claim 1, further comprising means for connecting the individually addressable electrodes to two or more power inputs.

5. The electroluminescent filament according to claim 1, wherein the core conductor is a multi-strand conductor.

6. The electroluminescent filament according to claim 1, wherein the individually addressable electrodes are embedded in the luminescing layer.

7. The electroluminescent filament to claim 1, wherein the individually addressable electrodes are disposed surrounding the luminescing layer.

8. The electroluminescent filament according to claim 1, further comprising an insulating layer surrounding the luminescing layer.

9. The electroluminescent filament according to claim 8, wherein the individually addressable electrodes are embedded in the insulating layer.

10. The electroluminescent filament according to claim 1, further comprising an inner insulating layer disposed between the core conductor and the luminescing layer.

11. An electroluminescent filament, comprising:

(a) a multi-strand core conductor;

(b) an inner insulating layer at least partially surrounding the core conductor;

(c) a luminescing layer at least partially surrounding the inner insulating layer;

(d) an outer insulating layer at least partially surrounding the luminescing layer; and (e) two or more individually addressable electrodes braided together and embedded in the outer insulating layer.

12. The electroluminescent filament according to claim 11, further comprising means for applying a voltage difference between the core conductor and a first subset of the individually addressable electrodes, and for applying a voltage difference between the core conductor and a second subset of the individually addressable electrodes.

13. The electroluminescent filament of claim 11 further comprising a coupler for coupling each of said individually addressable electrodes to a power supply.

14. The electroluminescent filament of claim 13 wherein said coupler substantially insulates each of said individually addressable electrodes and said multi-strand core conductor from one another.

15. An electroluminescent filament, comprising:

a non-conducting core;

a luminescing layer surrounding the non-conducting core; and two or more individually addressable electrodes each insulated from one another, braided together to form an outer electrode.

16. The electroluminescent filament of claim 15 wherein said non-conducting core is a cotton fiber.

17. The electroluminescent filament of claim 15 wherein said outer electrode is embedded in said luminescing layer.

18. The electroluminescent filament of claim 15 further comprising a coupler configured to couple each of said individually addressable electrodes to a power supply.

19. The electroluminescent filament of claim 18 wherein said coupler is configured to substantially insulate each of said individually addressable electrodes from one another.

20. The electroluminescent filament of claim 15 wherein each of said individually addressable electrodes is configured to receive an individual signal such that each of said individually addressable electrodes is capable of selective energization.

21. The filament of claim 20 wherein when said individually addressable electrode is energized, only the portion of said luminescing layer between said energized electrode and said core conductor luminesces.

22. An electroluminescent filament, comprising:

a core conductor;

a luminescing layer at least partially surrounding the core conductor; and two or more individually addressable electrodes disposed around the core conductor;

wherein each of said individually addressable electrodes is configured to receive an individual signal such that each of said individually addressable electrodes is capable of selective energization.

23. The filament of claim 22 wherein when said individually addressable electrode is energized, only the portion of said luminescing layer between said energized electrode and said core conductor luminesces.

24. The electroluminescent filament of claim 22 further comprising a coupler configured to couple each of said individually addressable electrodes to a power supply.

25. The electroluminescent filament of claim 24 wherein said coupler is configured to substantially insulate each of said individually addressable electrodes from one another.

* * * * *